United States Patent [19]

Franzmeier

[11] 4,028,895

[45] * June 14, 1977

[54] RAIN GUTTER ATTACHMENT

[76] Inventor: Alvin W. Franzmeier, 1042 E. Jenks Ave., St. Paul, Minn. 55106

[ * ] Notice: The portion of the term of this patent subsequent to June 17, 1992, has been disclaimed.

[22] Filed: Nov. 14, 1975

[21] Appl. No.: 631,819

[52] U.S. Cl. ..... 61/14; 52/16

[51] Int. Cl.[2] ..... E02B 9/04; E04D 13/06

[58] Field of Search ..... 61/12, 14, 15; 52/16

[56] References Cited

UNITED STATES PATENTS

| | | | |
|---|---|---|---|
| 248,328 | 10/1881 | Kaltenbach | 52/16 X |
| 2,821,154 | 1/1958 | Tennison | 61/15 |
| 2,887,073 | 5/1959 | Thompson | 52/16 |
| 3,889,474 | 6/1975 | Franzmeier | 61/14 |

FOREIGN PATENTS OR APPLICATIONS

| | | | |
|---|---|---|---|
| 855,581 | 12/1960 | United Kingdom | 52/16 |

*Primary Examiner*—Paul R. Gilliam
*Assistant Examiner*—David H. Corbin

[57] ABSTRACT

A rain gutter attachment which includes a section capable of fitting between two sections of a rain gutter of conventional form. This attachment section includes a central flat outer surface having a pair of apertures therethrough, one aperture adjoining the bottom of the attachment center, and the other aperture above the level of the first and offset laterally therefrom. Elbows or straight sections of downspout are in communication with these apertures. A solar heat box is secured to the flat central portion of the attachment enclosing portions of the elbows or downspout sections.

10 Claims, 11 Drawing Figures

RAIN GUTTER ATTACHMENT

This invention relates to an improvement in rain gutter attachment and deals particularly with a section which may be interposed in a rain gutter when it is being made or reconstructed, and which will result in an effective means of removing the water from rain gutters. While particularly designed for use in countries where the rain gutters have a tendency to freeze and thaw, it is also effective for use in rain gutters which have a tendency to fill up with leaves so that they do not drain properly.

BACKGROUND OF THE INVENTION

In my previous U.S. Pat. No. 3,889,474 issued June 17, 1975, I describe a rain gutter attachment which fits into a notch formed in the forward side of the rain gutter, and which included a pair of outlets, located one above the level of the other. While this structure has proven to be very satisfactory, it has been found in action practice to have certain disadvantages. The main disadvantage lies in the fact that the structure requires that a notch be cut in the forward wall of the rain gutter, and that attachment brackets for connecting the attachment to the rain gutter had to be riveted or screwed with metal screws to the forward surface of the rain gutter. The main objection to this construction that in new installations, the notch had to be cut into the new section of rain gutter either before or after it was installed. Cutting a notch in the new rain gutter at the time of its installation was objectionable to many persons even though they recognized the advantage of the construction. A feature of the present invention resides in the provision of a structure which avoids these previous objections.

SUMMARY OF THE INVENTION

The present structure, while having certain advantages, is quite similar in effect to the construction previously produced. However, the step of cutting one or more notches in the rain gutter, and the securing of the brackets to the gutter has now been eliminated. Instead in forming new rain gutters on new structures, or reconstructing the rain gutters of old buildings, a section is inserted in the rain gutter which includes end portions which conform to the shape and contour of the remainder of the gutter, so that the attachment may be inserted into the conventional rain gutter at any point along its length by use of the conventional slip joints which were commonly used to connect the sections of a gutter in end abutting relation. These slip joints include an outer member which conforms to the outer shape of the conventional gutter, and an inner member having edges spaced inwardly from the inner surfaces of the outer member to accommodate the gutter sections therebetween. The manner of connecting the inner and outer slip joint members in parallel relation may vary with different constructions. However, one form of construction commonly used include an outer member which conforms to the shape of the outer surface of the rain gutter, an inner member which is secured in fact contact with the center portion of the outer member and which is provided with offset edges which extend in spaced parallel relation to the inner surface of the outer member so as to accommodate a gutter section or other fitting therebetween. By the term other member, I mean to imply end caps or the like instead of an adjoining section.

A further feature of the present invention resides in the provision of a hose connection which may be supplied when desired to direct water into the rain gutter in order to clean it out and to cause the leaves in the gutter to be directed down the downspouts. By this means, most of the leaves and other debris collecting in the rain gutter may be directed to the downspouts, thereby eliminating much of the necessity of manually cleaning out the rain gutters when the downspouts become clogged up at their entrances.

A further feature of the present invention resides in the provision of a deflector which may be provided within the rain gutter adjoining the lowermost of the openings leading to a downspout. It has been found through the use of this deflector, twigs and material of this type which are within the rain gutter will normally tend to be deflected toward the rear side of the rain gutter, and will accordingly be turned by the flow of fluid within the rain gutter to be directed longitudinally of the downspout, and will not usually lie crosswise of the downspout in a manner to block the entrance thereto.

A feature of the preferred form of the invention lies in the provision of an inner flange encircling each outlet opening, and an outer flange in parallel spaced relation thereto. These flanges are preferably spaced apart a sufficient distance so that a sealant material may be inserted therebetween, before the elbow or other downspout member is attached thereto, causing the sealant material to flow on either side of the elbow or downspout member. Rivets or metal screws are then applied between the flanges, and through the downspout member to hold this member securely in position.

An additional feature of the present invention resides in the provision of a cover on the solar heating box encircling the downspouts. It has been found in actual practice that when this solar heating box is subjected to sunlight the temperature within the box greatly exceeds the outside temperature, thereby increasing the flow of fluid through the downspout. By providing heat to this particular area, much of the tendency for the downspouts to freeze up is eliminated, this being particularly true where the solar heat box contains elbows which tend to freeze up more quickly than the vertical portions of the downspouts which are normally exposed to the sun. Actual tests have proven that the temperature within the solar heating box is several degrees warmer than the outside temperature, and this is particularly true if the heating box is provided with a black or otherwise dark surface.

These and other objects and novel features of the present invention will be more clearly and fully set forth in the following specification and claims.

DESCRIPTION OF THE PREFERRED EMBODIMENTS

Figure 2:
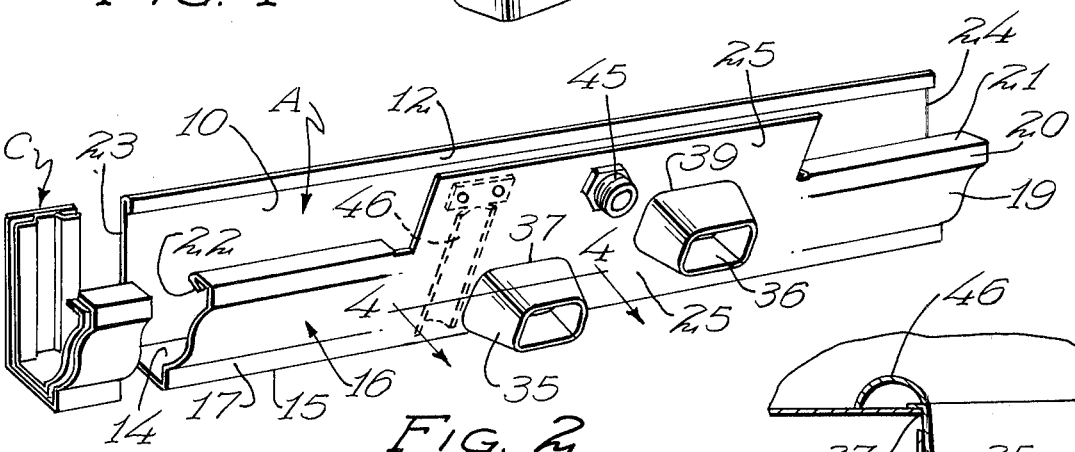
FIG. 2 is a perspective view of the section of rain gutter which is inserted into the rain gutter line.
Figure 3:
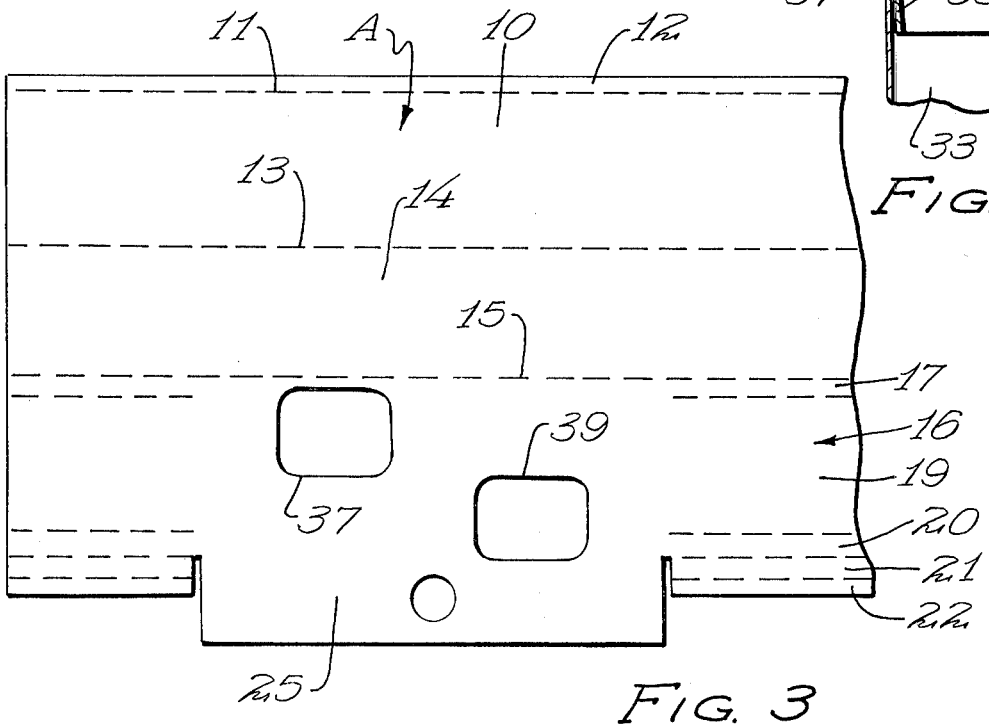
FIG. 3 is a diagrammatic view of the blank showing the general construction of the rain gutter sections shown in FIG. 2.

The rain gutter section which is inserted in line with the other sections is formed as perhaps best illustrated in FIGS. 2 and 3 of the drawings. Quite obviously this section is designed to fit the cross sectional shape of perhaps one of the most commonly used types of rain gutters at present on the market. The rain gutter section A is provided with a substantially vertical rear wall 10 which is normally folded along the fold line indicated by the dotted line 11 to a flange 12 which is usually folded to substantially 180° to extend in parallel relation to the rear wall 10. The rear wall 10 is connected along the fold line 13 to the bottom wall 14 which is normally supported at slight slant to the horizontal in order to slope toward the downspout area of the rain gutter. As this is common practice, it is not described in detail.

The forward edge 15 of the gutter bottom 14 is connected along the line 15 to the front wall which is indicated in general by the numeral 16. In the particular form illustrated the front wall 16 includes a vertical portion 17 connected to the bottom portion 14, and S-shaped portion 19 extending outwardly from the upper edge of the vertical portion 17, a vertical flange portion 20 secured to the upper edge of the S-shaped portion 19, a horizontal flange 21 extending horizontally toward the rear wall 10 and a reversely turned flange 22 secured to the edge of the horizontally extending portion 21 and which is bent outwardly beneath the flange 21 in order to present a rounded edge. While not being confined to the particular arrangement illustrated, this shape of gutter is customarily used in this part of the country, and the flange 20 and inturned flange 22 fill the purpose of reinforcing the construction, and preventing injury to the persons installing or cleaning out the rain gutter A. Obviously, the application's attachment could be used in rain gutters of almost any form, and the particular form illustrated is designed to merely illustrate the manner in which a gutter section may be formed rather than to limit the design to a particular type of construction.

As is perhaps best illustrated in FIG. 2 of the drawings, the ends 23 and 24 are designed to be of the same cross sectional shape as the rain gutter itself, and accordingly, the additional section A may be inserted by slip joints such as C which are well known in the art, and which are usually used for connecting the adjoining ends of rain gutter sections. No claim is made to the member C as they are well known in the art, and are commonly used for connectinng the adjoining ends of rain gutter sections together.

Figure 1:
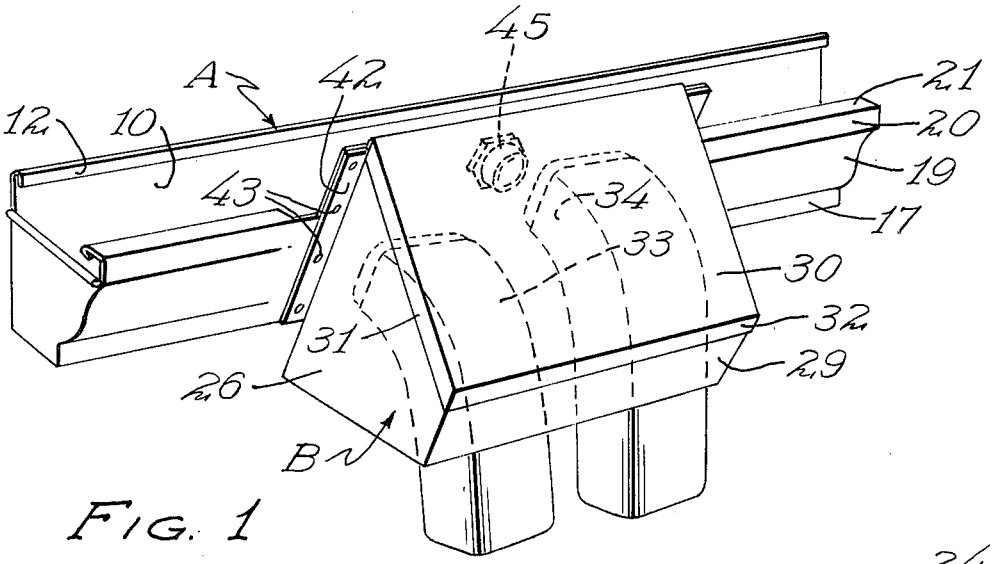
FIG. 1 is a perspective view of a rain gutter attachment illustrating one form of construction thereof.
Figure 5:
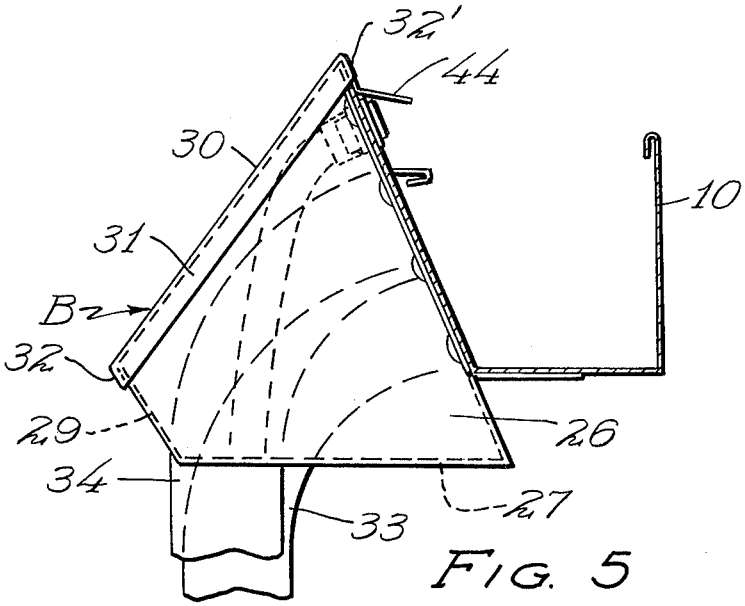
FIG. 5 is a sectional view through the rain gutter showing one side of the solar heat box.
Figure 6:
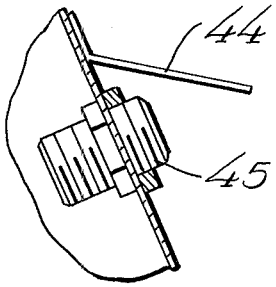
FIG. 6 is a sectional view showing the hose connection which may be provided at the top of the solar heat box.

The rain gutter section A differs from most such sections in having a flat center portion 25 to facilitate the attachment of the solar heat chamber B which will be described. As illustrated in FIGS. 1 and 5 of the drawings, the solar heat chamber B includes parallel side walls 26, a bottom wall 27, and a front wall 29. In preferred form, a cover 30 is equipped with peripheral flanges such as 31, and front and rear flanges such as 32 and 32′ form a cover for the solar heat box B, and provide a means of access to the interior thereof. By removal of the cover, the interior of the solar heat box B is readily available.

In the form of construction illustrated in FIGS. 1 through 6 elbows such as 33 and 34 are in communication with the spouts 35 and 36 which are extending forwardly from the flat portion 25 and which are shown in FIG. 2 as extending through the apertures 37 and 39 in the flat portion 25 of the attachment. The purpose of this entire arrangement is to provide communication between the rain gutter 10 and the downspouts, of which the elbows 33 and 34 are elements.

In the present application and claims, it is desired to point out that the downspout members may either extend angularly outwardly from the house or other building or may comprise angles which are connected to vertical downspouts in the event the vertical downspouts do not interfere with the drainage of water. Usually, in portions of the country which are subject to severe cold, the eaves extend well beyond the building so that a sidewalk may extend beneath the eaves to protect persons entering or leaving the building. However, in some instances, the roof terminates closely adjacent the house wall. In such a case, it is preferable to extend the downspouts outwardly and downwardly to a point spaced from the house so that the water collected may be delivered to points spaced away from the house walls sufficiently so that water will not drain into the basement.

Figure 4:
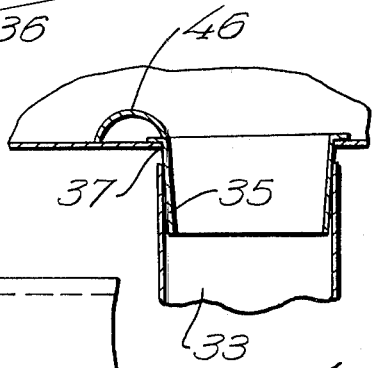
FIG. 4 is a sectional view through one of the outlets for the rain gutter, the position of the section being indicated by the line 4—4 of FIG. 2.

In the construction which has been described, the side walls 26 of the solar heat housing are provided with outwardly extending flanges 42 which are riveted or otherwise secured as indicated at 43 to the flat portion 25 of the rain gutter attachment A. As is also evident from FIG. 5 of the drawings, a deflector 44 is provided above the hose connection 45 so that the water from the hose connection will be deflected into the rain gutter. Also as indicated in FIGS. 2 and 4 of the drawings, a deflector 46 is attached to the inner surface of the flat portion 25 of the gutter section 10 which seems to serve a unique purpose. In other words, twigs or other such material which flow toward the outlets through the rain gutter 10 have a tendency for the forward ends thereof to be deflected toward the center of the gutter, and the water flowing through the gutter has a tendency to turn such twigs into the lower outlet 37 to be directed to the downspouts.

Figure 7:
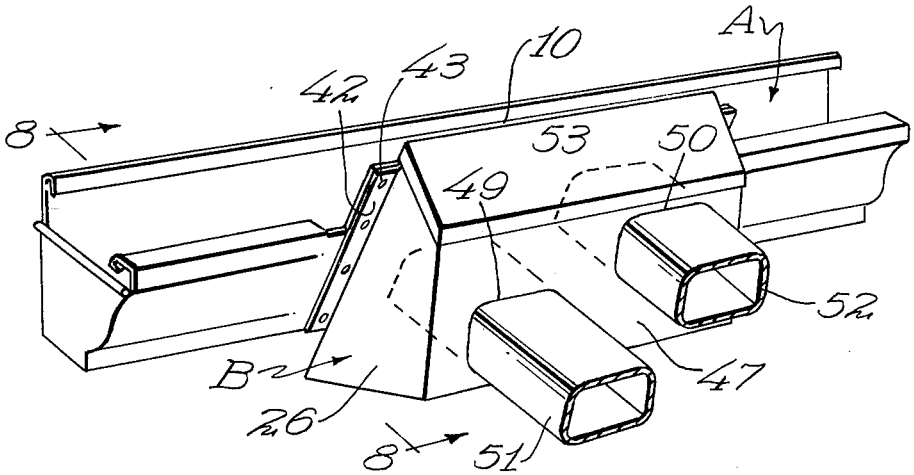
FIG. 7 is a perspective view of a slightly different form of construction in which the downspouts extend angularly outwardly from the building. This construction is employed particularly where the eaves do not project well beyond the wall of the house or other structure.
Figure 8:
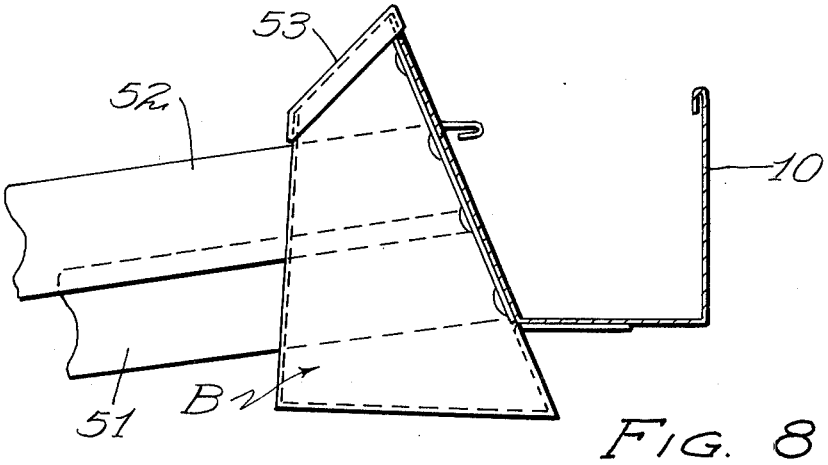
FIG. 8 is a sectional view through the rain gutter, showing in elevation the solar heat box connected thereto and the downspouts extending angularly and outwardly therefrom.

FIGS. 7 and 8 of the drawings indicate a very similar construction, but in which the downspouts extend outwardly and downwardly from the box B. This requires a somewhat different shape of box in which the forward wall 47 is somewhat taller from the creased line 34 and includes apertures 49 and 50 through which the straight portions 51 and 52 of the downspouts extend. While not shown in the drawings, this type of construction is used on housings or buildings where the edges of the roof terminate close to the house, and in which there is a sidewalk extending close to the house. The downwardly inclined downspout portions 51 and 52 are provided with elbows which turn downwardly so that liquid from the rain gutters may be deposited at a desired distance from the house. In actual practice, an ornamental grill or other covering member is supported by posts spaced on either side of the vertical downspouts so as to provide an ornamental appearance which will not detract from the appearance of the house. The vertical downspouts usually terminate in spaced relation to the ground so that any water freezing in these portions of the downspouts will drop downwardly to the ground when the sun heats these members. In view of the fact that this is a somewhat different arrangement from that previously described, it has not been illustrated except for the fact that the downspout portions 51 and 52 incline outwardly and downwardly from the rain gutter 10. A cover 53 serves the same capacity of the cover 30 which has been previously described, and acts to close the upper end of the solar heat box B.

Figure 9:
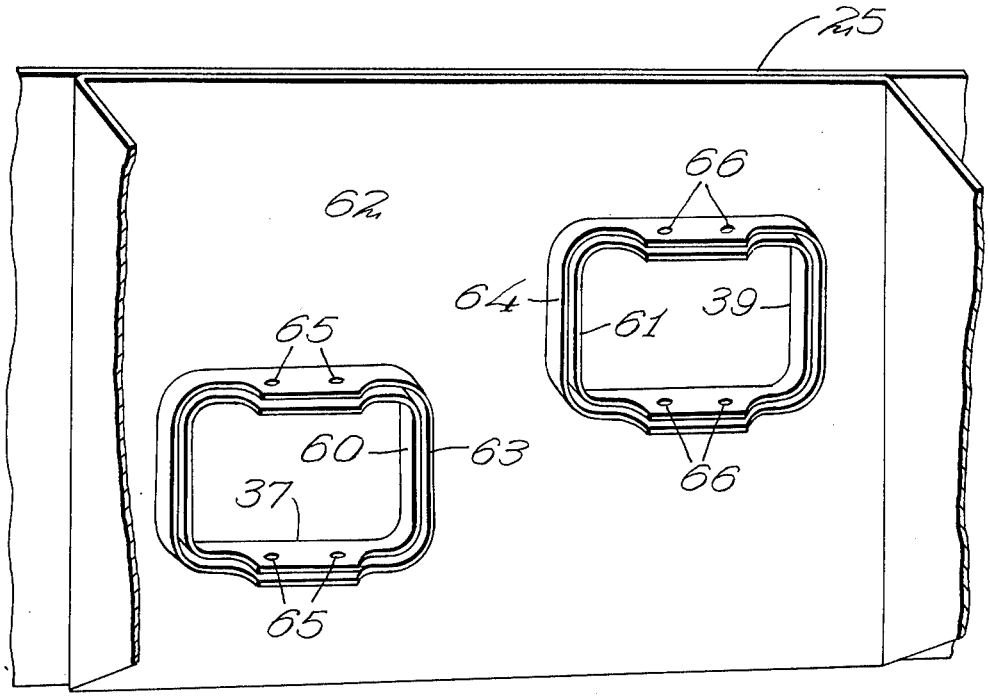
FIG. 9 is an elevational view of the plate which may be attached to the flat portion of the rain gutter and showing inner and outer spaced flanges between which the downspout member may be anchored.
Figure 10:
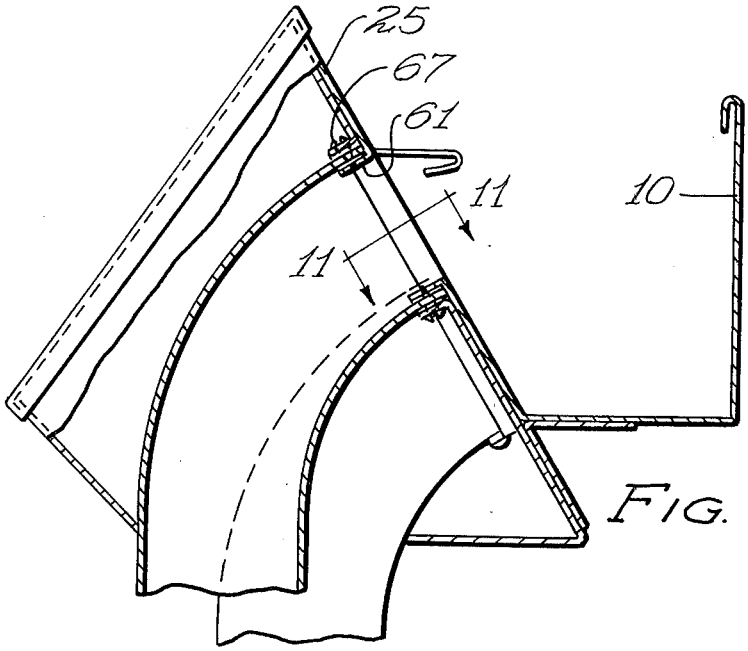
FIG. 10 is a sectional view through the rain gutter, and through portions of the upper outlet and elbow connected thereto.

FIGS. 9 and 10 of the drawings show a somewhat improved construction which has been found somewhat easier to produce than that previously described. As is shown, the structure still involves the flat plate 25 forming a part of the rain gutter. However, in the construction shown in these figures, in place of the separate discharge members 35 and 36, out turned flanges 60 are provided encircling the lower opening 37, and similar out turned flanges 61 are provided encircling the upper apertures 39. These out turned flanges 60 and 61 form the same purpose as the spouts 35 and 36. However, a plate 62 is secured to the outer surface of the flat portion 25 of the rain gutter section 10, and the plate 60 is apertured to conform with the apertures 37 and 39 and the plate portion 25. Flanges 63 and 64 are formed outwardly from the apertures in the plates 62 to provide flanges which are in spaced relation to the flanges 60 and 61. The end of the downspout member is inserted between these flanges and is preferably cemented in place. Rivets or metal screws are inserted through the apertures 65 and 66 in order to hold the elbows or downspout portions in position.

Figure 11:
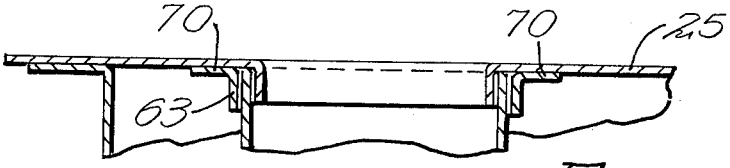
FIG. 11 is a cross sectional view generally indicated by the line 11—11 of FIG. 10, but showing flanges secured to the outer spaced flanges for securing the outer spaced flanges to the flat outer surface of the central flat portion of the attachment.

It should be explained that the downspout portions which have been described comprise either elbows such as are shown in FIGS. 1 through 5 of the drawings or straight lengths of downspouts as indicated in FIGS. 7 and 8. In any event, with the construction shown in FIGS. 9 and 10, the elbows or downspouts portions may be connected by rivets 67 to secure the downspout portion in place. FIG. 11 shows a construction which is very similar to that shown in FIGS. 9 and 10 except for the fact that in place of the plate 62, outwardly extending flanges such as 70 are provided to hold the outer flanges 63 and 64 in place. Here again, a sealing compound would be inserted between the flanges before the elbows or downspout members are inserted so as to thoroughly seal these members together before they are riveted or otherwise secured.

In view of the different variations of rain gutters and downspouts, it is difficult to explain the possibilities of the various forms of construction. In view of the fact that the downspouts and the elbows are normally of the same general periphery, any of the construction could be used, but actually the structure shown in FIGS. 9 through 11 are probably the easiest and hold the downspout portions most securely. In the following claims, in describing the words "downspout portions", it is desired to make it understood that the downspout portions could be either elbows or straight portions depending upon the particular situation.

In accordance with the Patent Statutes, I have described the principles of construction and operation of my Rain Gutter Attachment, and while I have endeavored to set forth the best embodiments, I desire to have it understood that obvious changes may be made within the scope of the following claims without departing from the spirit of my invention.

I claim:

1. An attachment for a rain gutter of substantially uniform cross section and including an inner side adapted for attachment to the eaves of a building, a bottom side, and an outer side of other than flat form, said attachment including a gutter section including end portions conforming to the cross sectional shape of the rain gutter, and a flat central portion on the outer side of said attachment, said flat central portion having a pair of spaced apertures extending therethrough, one of said apertures being adjacent to the bottom wall of said attachment and the other aperture being above the level of, and offset from, the first mentioned aperture.

2. The structure of claim 1 and including means encircling said apertures each adapted to accommodate a downspout member.

3. The structure of claim 2 and including a solar heat box secured to the outer surface of said flat central portion of said attachment.

4. The structure of claim 3 and in which said heat box includes a removable cover.

5. The structure of claim 3 and in which said heat box includes apertures through which said downspout members may extend.

6. The structure of claim 2 and in which said means encircling said apertures includes an inner flange adapted to extend into a downspout member, and a spaced outer flange adapted to encircle the downspout member.

7. The structure of claim 2 and including a hose connection extending through said flat central portion of said attachment above the level of said apertures.

8. The structure of claim 6 and in which said outer flange is supported by flange means in surface contact with, and connected to, said flat central portion of said attachment.

9. The structure of claim 6 and in which said outer flange is connected to a plate secured in surface contact with said flat central portion of said attachment.

10. The structure of claim 1 and including a baffle member extending into said attachment adjoining said one aperture and extending parallel with said central flat portion of said attachment.

* * * * *